US009528530B2

(12) United States Patent
Hummer

(10) Patent No.: US 9,528,530 B2
(45) Date of Patent: Dec. 27, 2016

(54) SYSTEM FOR THE HEATING AND PUMPING OF FLUID

(76) Inventor: Kirk D. Hummer, Grand Valley, PA (US)

( * ) Notice: Subject to any disclaimer, the term of this patent is extended or adjusted under 35 U.S.C. 154(b) by 1233 days.

(21) Appl. No.: 13/450,531

(22) Filed: Apr. 19, 2012

(65) Prior Publication Data

US 2013/0280035 A1 Oct. 24, 2013

(51) Int. Cl.
*F04D 13/00* (2006.01)
*F04D 29/58* (2006.01)
*F04D 1/06* (2006.01)

(52) U.S. Cl.
CPC ..... *F04D 29/586* (2013.01); *F04D 1/06* (2013.01)

(58) Field of Classification Search
CPC ..... F04D 29/58; F04D 29/586; F04D 13/00; F04D 1/06; F24J 3/003
USPC ..... 122/26; 126/247
See application file for complete search history.

(56) References Cited

U.S. PATENT DOCUMENTS 2,683,448 A * 7/1954 Smith ..... F04D 29/582 122/26
4,025,225 A 5/1977 Durant ..... 415/90
4,231,974 A * 11/1980 Engelbrecht ..... B01F 3/04539 209/170
4,273,075 A 6/1981 Freihage ..... 122/26
4,285,329 A 8/1981 Moline ..... 126/247
4,304,104 A * 12/1981 Grose ..... F04D 1/12 415/88
4,312,322 A 1/1982 Freihage ..... 126/247
4,381,762 A * 5/1983 Ernst ..... F24J 3/003 122/26
4,590,918 A 5/1986 Kuboyama ..... 126/247
4,678,400 A 7/1987 Kuboyama ..... 415/199.4
4,685,443 A * 8/1987 McMurtry ..... F24J 3/003 122/26
4,779,575 A 10/1988 Perkins ..... 122/26
5,683,031 A 11/1997 Sanger ..... 237/1 R
5,901,670 A 5/1999 Morol et al. ..... 122/26
(Continued)

FOREIGN PATENT DOCUMENTS

WO WO 2005/003641 A2 1/2005

OTHER PUBLICATIONS

Experimental study of heating fluid between two concentric cylinders with cavities, springerlink.com website: https://springerlink3.metapress.com/content/96714254h447w630/.

*Primary Examiner* — Eric Keasel
*Assistant Examiner* — Maxime Adjagbe
(74) *Attorney, Agent, or Firm* — Jonathan M. D'Silva; MMI Intellectual Property

(57) ABSTRACT

A fluid heating and pumping system comprising a housing that has an inlet and outlet opening as well as a plurality of turbine chambers. Each of the turbine chambers has: an inlet end, outlet end, is mounted to a driveshaft, a stator and rotor, and is constructed to create a circuitous flow path for fluid flow. Each of the rotors is: designed to move the fluid through the housing, and has a plurality of rotor vanes with each having a fin at the inlet end. The fin extends past the plane of an adjacent rotor vane to extend the circuitous flow path through the rotors. The fins, shearing plane, and outlet orifice all create thermal energy as the fluid is transferred along and between the rotor and stator vanes, through the shearing plane and between the adjacent turbine chambers as the fluid flows.

12 Claims, 13 Drawing Sheets

(56) References Cited

U.S. PATENT DOCUMENTS

| | | | | |
|---|---|---|---|---|
| 6,684,822 | B1 | 2/2004 | Lieggi | 122/26 |
| 2005/0074330 | A1* | 4/2005 | Watson | F04D 1/063 415/199.2 |
| 2009/0235914 | A1 | 9/2009 | Derman | 126/247 |

* cited by examiner

SYSTEM FOR THE HEATING AND PUMPING OF FLUID

BACKGROUND

Typical water heating devices can be costly, hard to move, unreliable, and hazardous because these water heating devices have large tanks for storing stagnated water that use electric coils or burning apparatuses that cause the devices to break down easily. The system for heating and pumping fluid described hereafter is a durable, reliable, cost effective, and less hazardous alternative to the traditional water heating device on the market today.

SUMMARY

A fluid heating and pumping system comprising a housing having an inlet opening and an outlet opening and a plurality of turbine chambers within the housing. Each of the turbine chambers has an inlet end and an outlet end. Each of the turbine chambers comprises a stator and a rotor both of which are centered on an axis of rotation. Each of the turbine chamber rotors is mounted to a driveshaft. The driveshaft rotates about the axis of rotation. Each of the turbine chambers is constructed to create a circuitous flow path for fluid flow. A separating plate is located between the adjacent turbine chambers, the separating plate has at least one separating plate orifice through which fluid can flow between adjacent turbine chambers. Each of the rotors is designed to move the fluid axially or radially through the housing. Each of the rotors has a plurality of rotor vanes with each of the rotor vanes having a fin at the inlet end. The fin extends past the plane of an adjacent rotor vane to extend the circuitous flow path through the rotors. Each of the stators has a plurality of axially extending stator vanes. The rotors and stators are sized and mounted to form a shearing plane between them. Each of the stators has an end member with at least one outlet orifice situated at the outlet end to allow fluid to flow through at least one opening in an adjacent separating plate orifice. The fins, shearing plane, and outlet orifice create thermal energy as the fluid is transferred along and between the rotor vanes and stator vanes, through the shearing plane and between the adjacent turbine chambers as the fluid flows circuitously from the inlet opening to the outlet opening.

In some embodiments the fluid heating and pumping system, each of the rotor vanes could have a plurality of rotor orifices through which fluid can pass to further increase the thermal energy generated as the rotor rotates. The fluid heating and pumping system could have three turbine chambers within the housing. The fluid heating and pumping system could also further comprise an outlet opening that is perpendicular to the axis of rotation and have a turbine chamber that is positioned closest to the outlet opening, within the housing, be an outlet chamber that is designed to move the fluid radially through the outlet opening.

The fluid heating and pumping system could further comprise an outlet opening that is perpendicular to the axis of rotation and have a turbine chamber positioned closest to the outlet opening, within the housing, be an outlet chamber that has rotor vanes mounted both radially and parallel to the axis of rotation such that the fluid flows through the outlet opening. The fluid heating and pumping system could further comprise at least one of the turbine chambers having each of the rotor vanes and each of the stator vanes mounted at compound angles such that the axial length of each of the rotor vanes and stator vanes are at an acute angle with respect to the axis of rotation and the radial length of each of the rotor vanes and stator vanes are tilted at a second angle with respect to the surface of the drive shaft. The fluid heating and pumping system could have the inlet opening and the outlet opening both be mounted such that they extend perpendicular to the axis of rotation. The fluid heating and pumping system can have an outlet opening that is mounted parallel to the axis of rotation.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
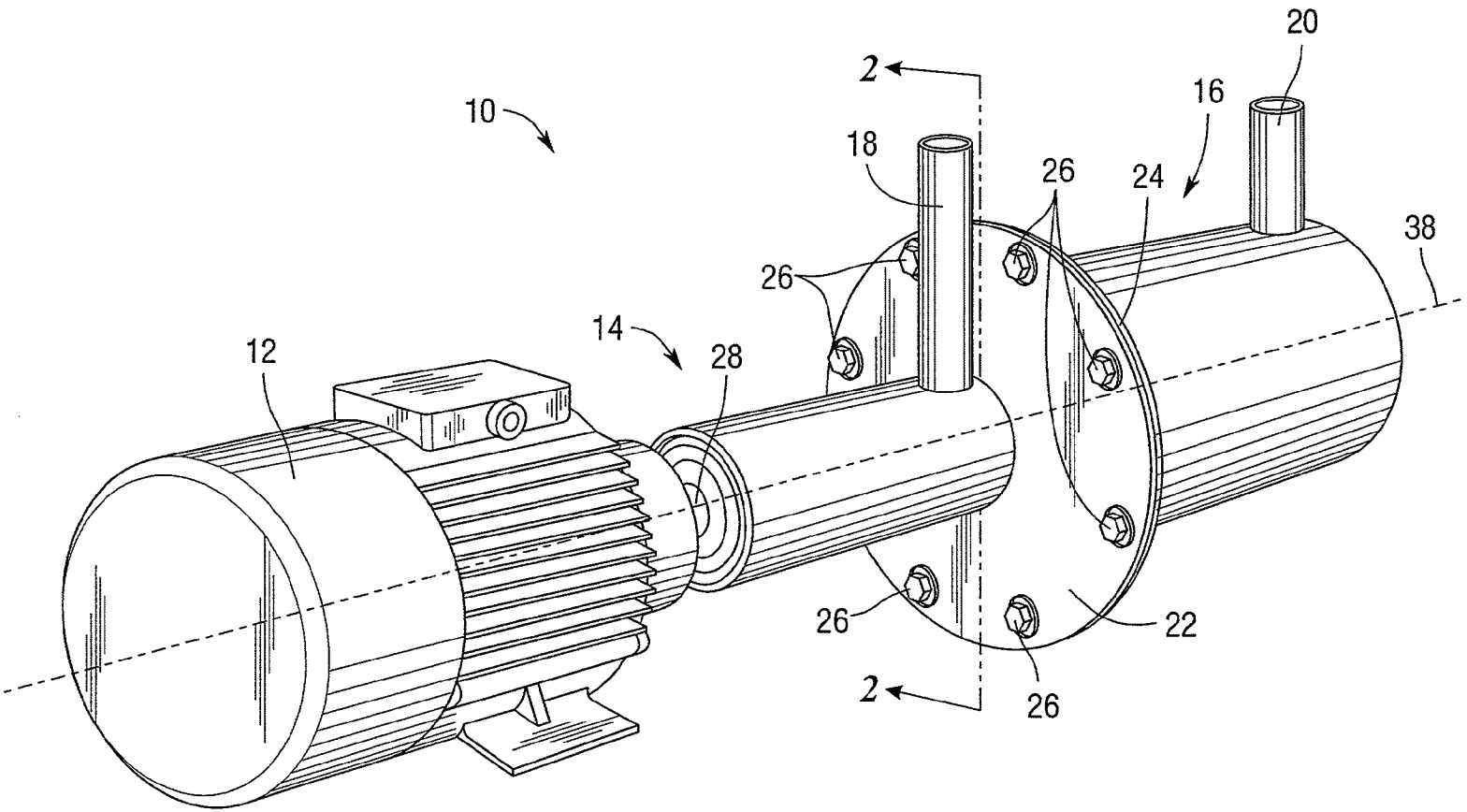
FIG. 1 is a perspective view of the system for heating and pumping fluid.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Effective fluid heating and pumping is possible with the embodiment described herein and shown in FIG. 1. A fluid heating and pumping system 10 comprises an actuator 12 that is mounted to a housing having an inlet housing 14 and an outlet housing 16. Typically, the inlet housing 14 has an inlet opening 18, perpendicular to the axis of rotation 38, through which the fluid enters the system 10. However, the inlet housing 14 could have an inlet opening 18 that is parallel to the axis of rotation 38. The fluid, to be heated, is part of a closed loop system in which the fluid, typically water, is continuously recycled through the system 10 and slowly heated up to a desired temperature. A thermostat, thermocouple, or other temperature sensitive feedback device may be incorporated into the system 10 to regulate when the system is turned off or on as required by the particular application.

The outlet housing 16 has an outlet opening 20, perpendicular to the axis of rotation 38, from which heated fluid can leave the system 10. Both the inlet opening 18 and the outlet opening 20 have a variety connection options (not shown) such as but not limited to: quick disconnects, threaded ends, or flanges to connect to the system. The inlet housing 14 has a flange 22 which lines up to a corresponding flange 24 on the outlet housing 16. The flanges 22 and 24 are joined by a plurality of fastening devices 26 such as nuts and bolts to form a leak-proof seal. A rubber gasket or other sealing feature could be incorporated between the flanges 22 and 24 to provide additional leak protection. In the embodiment shown in the figures, the inlet housing 14 and outlet housing 16 are joined to align the inlet opening 18 and outlet opening 20 so that fluids enter and leave the system 10 vertically. Generally, the system 10 is made of stainless steel or any non-corrosive material that is strong enough to withstand long term use.

The actuator 12 provides power to the entire system 10 and could be any drive system that will rotate the shaft. The actuator 12 can be releasably joined to a drive shaft 28 that runs through the center of the inlet housing 14 and the outlet housing 16 as well as rotates around an axis of rotation 38. The actuator unit 12 forces the drive shaft 28 to rotate continuously and at a torque that is powerful enough to rotate the inner components of the system 10 (described in more detail below) through the viscosity of fluids flowing circuitously between the inlet opening 18 and the outlet opening 20. A steel rod approximately ⅔ inch in diameter was found to be sufficient for a drive shaft 28 in the preferred embodiment of this system.

Figure 2:
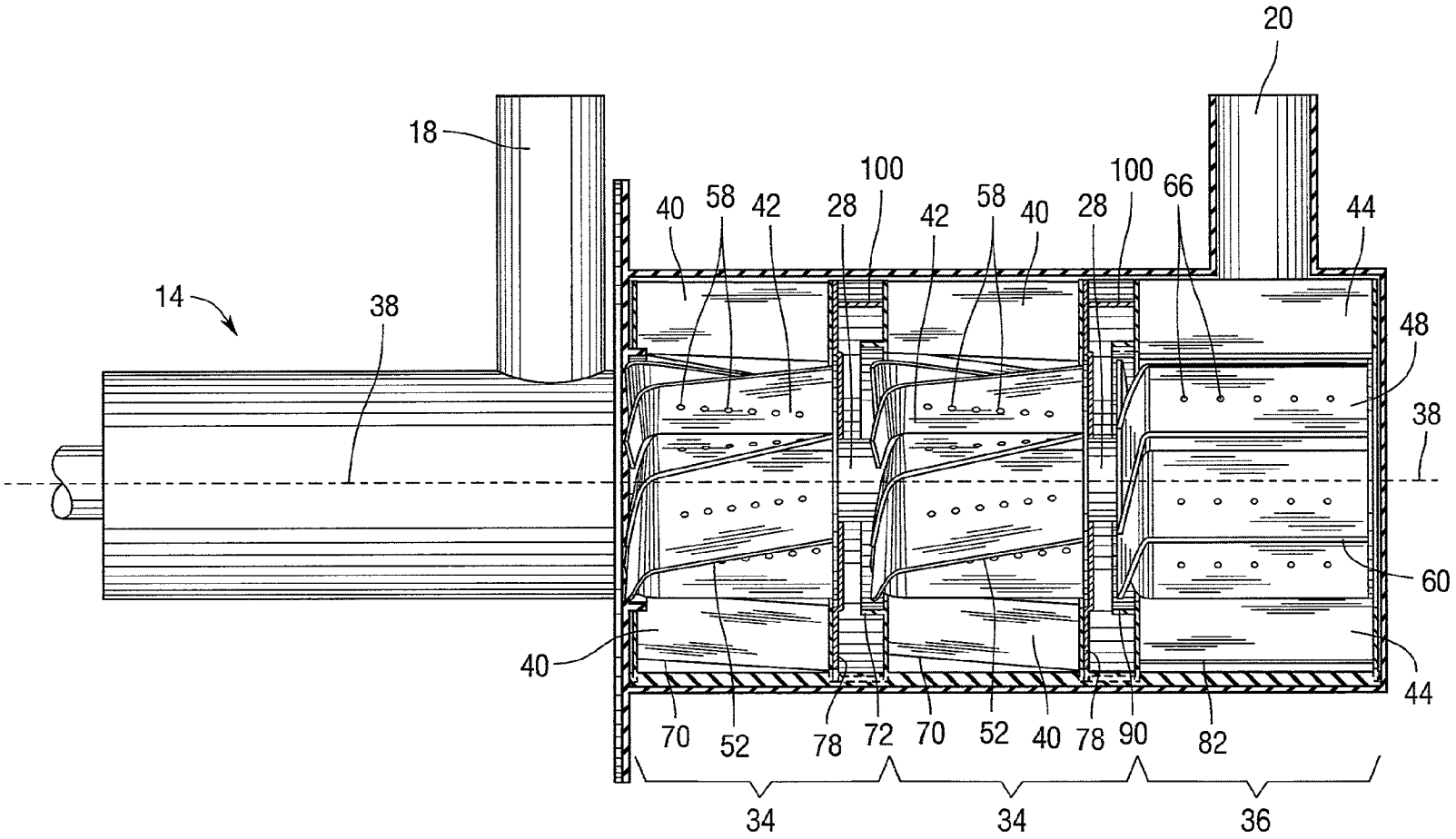
FIG. 2 is a cut away side view detailing the internal components of the system.
Figure 3:
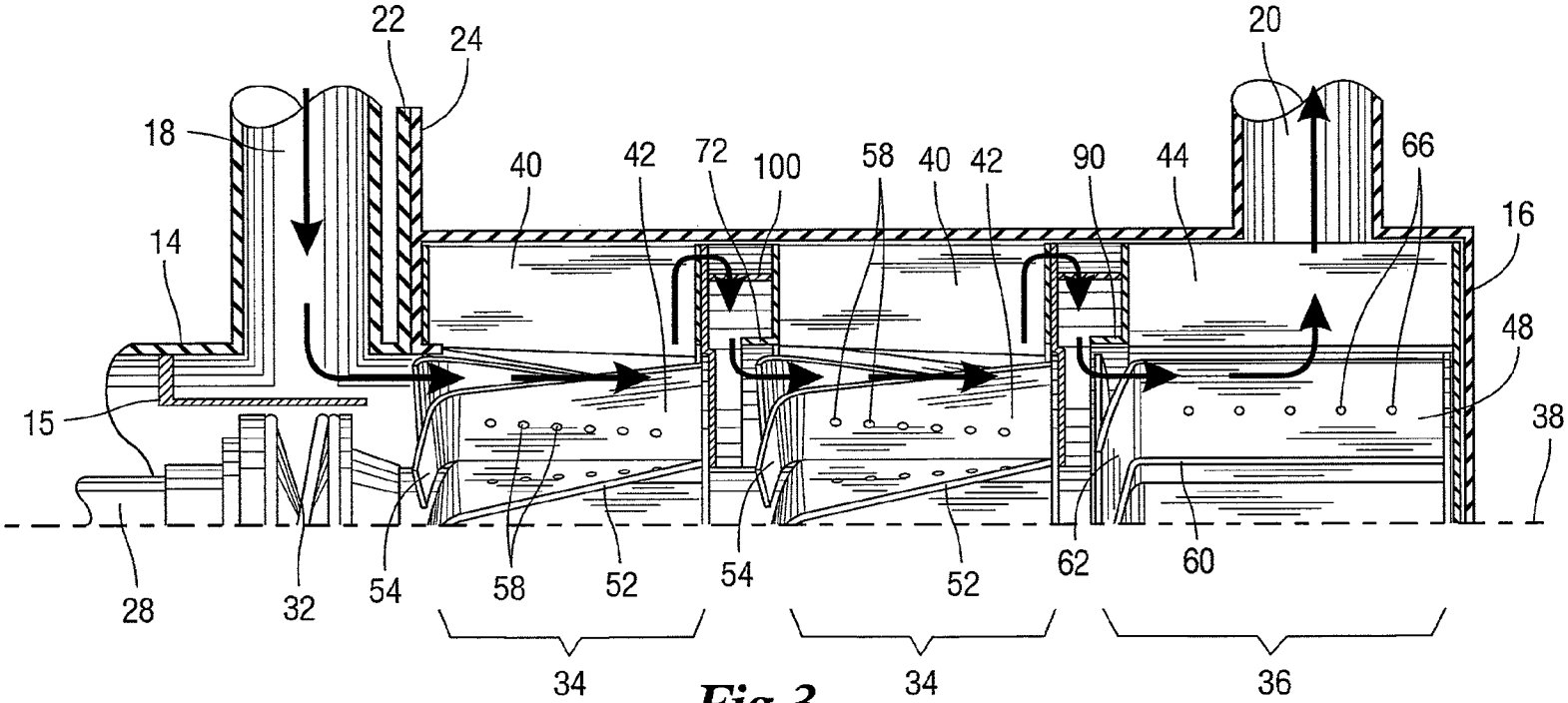
FIG. 3 shows the path of fluid flowing circuitously through FIG. 2.
Figure 4:
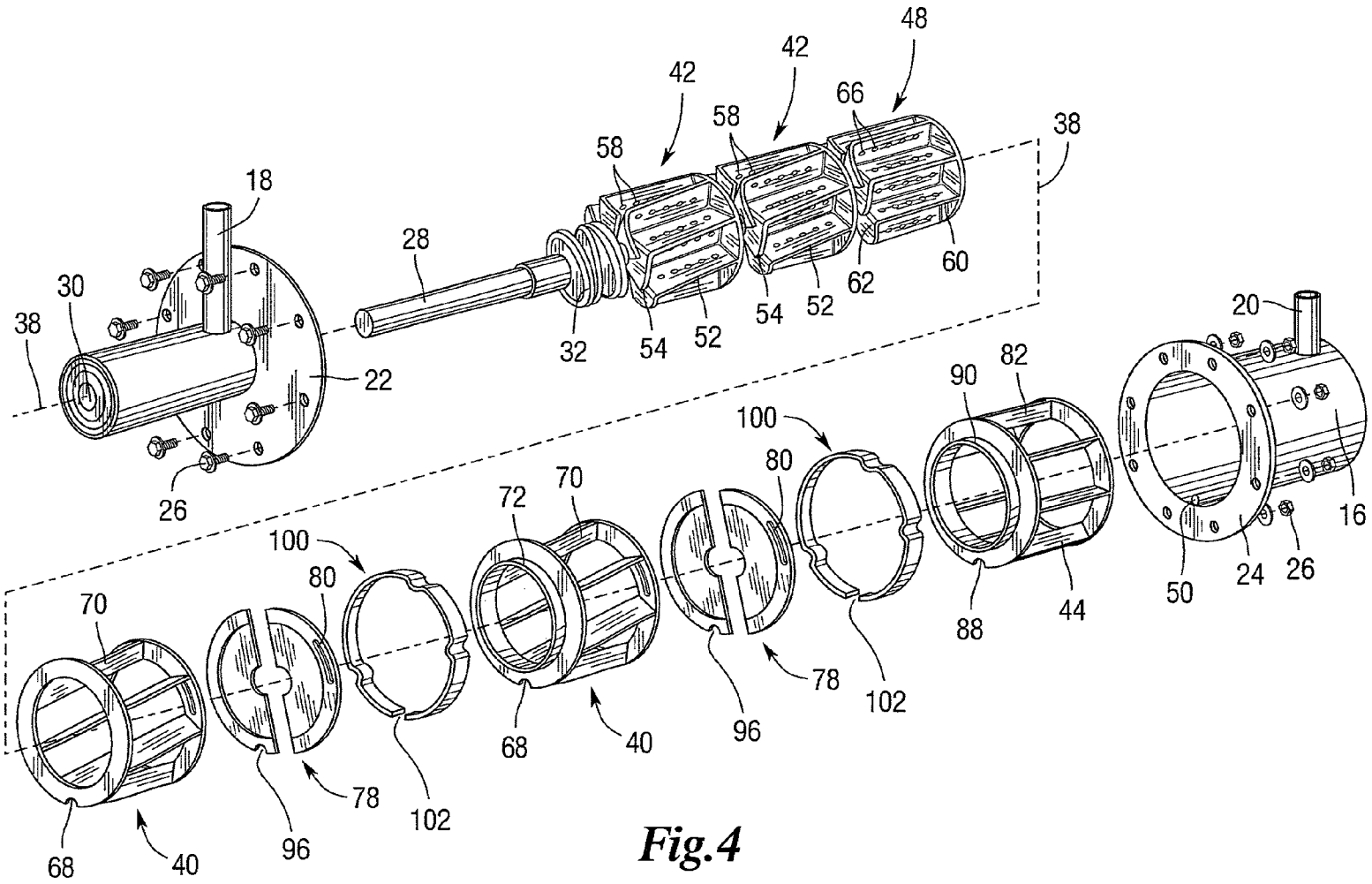
FIG. 4 is an exploded perspective view showing each component of the system.
Figure 5A:
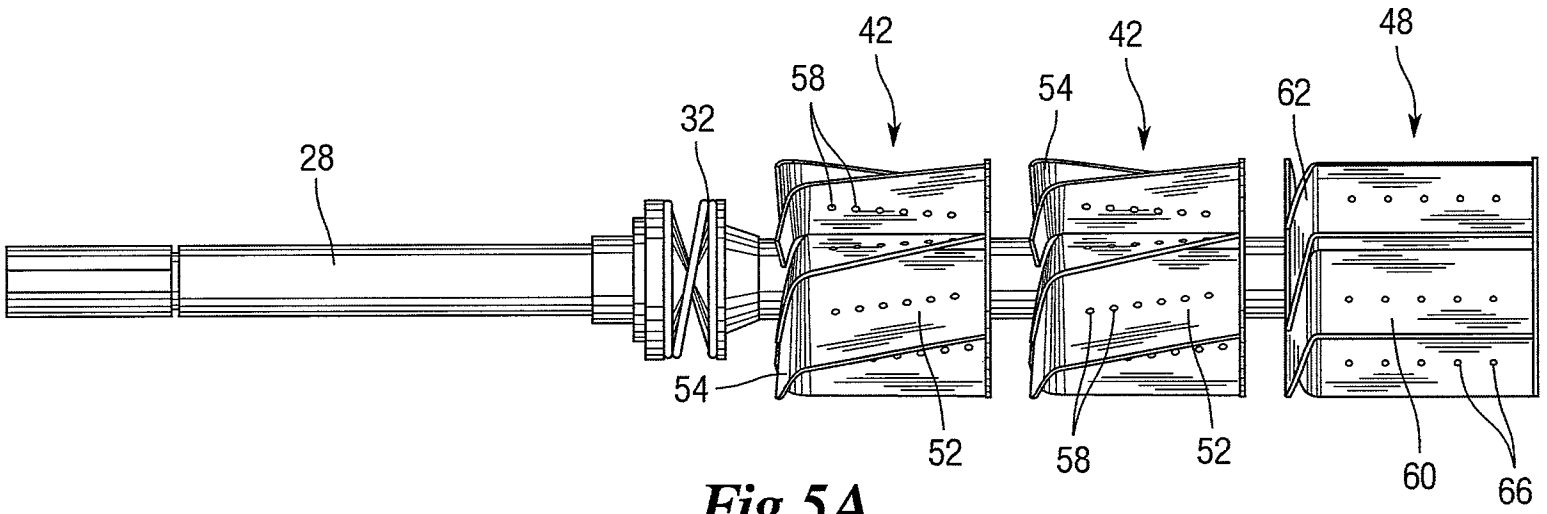
FIG. 5A is the preferred embodiment of the drive shaft having rotors mounted onto it.
Figure 5C:
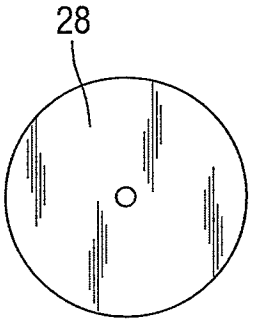
FIG. 5C is a rear view of FIG. 5A.
Figure 5B:
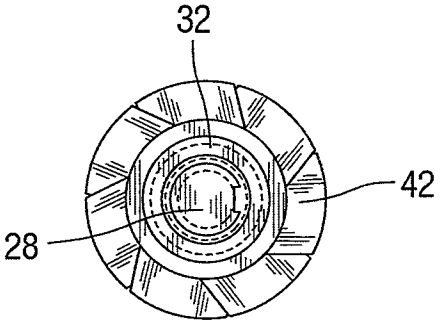
FIG. 5B is a front view of FIG. 5A.
Figure 6C:
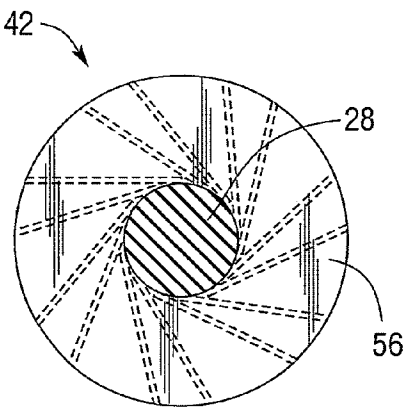
FIG. 6C is a rear view of FIG. 6A.
Figure 6A:
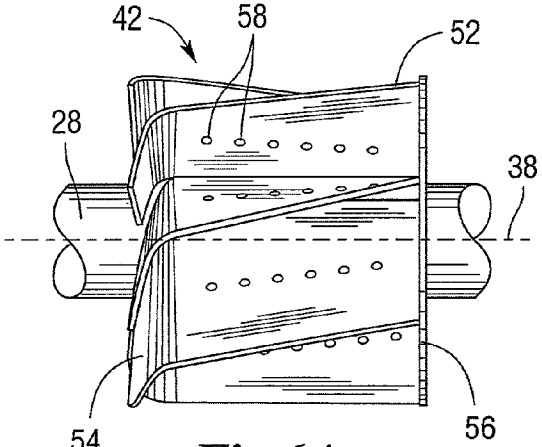
FIG. 6A is a side view of a rotor having rotor vanes at compound angles.
Figure 6B:
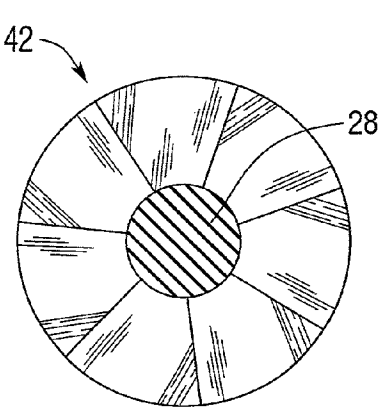
FIG. 6B is a front view of FIG. 6A.

The inner workings of the system 10 for heating and pumping fluid is best understood by referring generally to FIGS. 2, 3, and 4. The inlet housing 14 has a cylindrical ball bearing joint 30 that supports the drive shaft 28 for rotating about the axis of rotation 38. The drive shaft 28 has a sealing member 32 that locks into the ball bearing joint 30 to provide a leak proof seal between the inlet housing 14 and the drive shaft 28. Fluid to be heated enters the inlet housing 14 through the inlet opening 18 and it subsequently passes directly into the outlet housing 16. The sealing member 32 blocks any fluid from leaking out through the ball bearing joint 30. The inlet housing 14 also has a collar 15 that helps to move the fluid flow from the inlet opening 16 to nearest turbine chamber 34 as well as prevent backflow of the fluid from the inlet opening 16. However, the collar 15 is not necessary in all embodiments of the system such as embodiments where the inlet opening is parallel to the axis of rotation 38).

Within the outlet housing 16 are located a plurality of turbine chambers 34 that each have an inlet end and an outlet end. These turbine chambers 34 include a single outlet chamber 36 that is positioned closest to the outlet opening 20 such that it is just below the outlet opening 20 within the outlet housing 16. The actual number of turbine chambers 34 can vary with the particular application, but the preferred embodiment is as shown in the figures with two turbine chambers 34 and a third outlet chamber 36 although it will be understood that any number of turbine chambers 34 would also be effective. The turbine chambers 34 and the outlet chamber 36 are all centered on an axis of rotation 38 that runs through the drive shaft 28. Each of the turbine chambers 34 comprises a fixed stator 40 around a rotor 42, that is mounted to the drive shaft 28, both of which are also centered on the axis of rotation 38. Except for the outlet chamber 36, the turbine chambers 34 are constructed to create a circuitous flow path for fluid flow. The outlet chamber 36 also has its own fixed stator 44 and rotor 48 both of which are centered on the axis of rotation 38, but, as will be described in more detail below, they are configured differently than the stators 40 and rotors 42 of the turbine chambers 34 depending on the orientation of the outlet opening 20.

As will be explained in more detail below, the angled shape of the rotors 42 in each turbine chamber 34 forces fluid from the inlet opening 18 through the circuitous path as shown in FIG. 3. Thus, except for the outlet chamber 36, the turbine chambers 34 are constructed to create a circuitous flow path for fluid flow. The outlet chamber 36 is designed to move the fluid radially within the outlet housing 16. The rotor vanes 52, as discussed in more detail below, in the outlet chamber 36 are mounted both radially and parallel to the axis of rotation 38. This movement of fluid causes pressure to build up within the outlet chamber 38 giving the fluid nowhere to go except through the outlet opening 20 to leave the system 10.

As can be seen in FIG. 4, a guiding ridge 50 (in the preferred embodiment a thin wire of metal) is permanently attached to the inside of the outer housing 16. The guiding ridge 50 provides a means against which the non-moving parts of the system 10 can be located and held in place within the outlet housing 16. As will be shown below, each of the non-moving parts in the system have corresponding divots that line up with the guiding ridge 50.

As can be best understood by comparing FIGS. 4 through 6C, the rotors 42 and 48 are each permanently joined to the drive shaft 28 so they are made to turn with the drive shaft 28. FIG. 5B shows the drive shaft 28 as seen from the actuator 12 and shows the sealing member 32 and rotor 42 of the first turbine chamber 34. FIG. 5C shows a view of the drive shaft 28 as seen from the outlet housing 16.

With respect to the turbine chambers 34, each of the rotors 42 has a plurality of rotor vanes 52. Depending on whether the fluid is in a turbine chamber 34 or outlet chamber 36, the rotors 34 are designed to move the fluid axially or radially through the outlet housing 16. As more clearly shown in FIGS. 6A, 6B, and 6C, the rotor vanes 52 of the turbine chamber 34 are mounted neither perpendicular nor parallel to the axis of rotation 38 but: 1) form a tilted angle with respect to the axis of rotation 38; and 2) the radial length of each of the rotor vanes 52 is not parallel with the drive shaft 28 but is tilted at a second angle with respect to the drive shaft 28. At the inlet end of the turbine chamber 34, each rotor vane 52 is bent into a fin 54 that extends past the plane of an adjacent rotor vane 52. As shown in FIG. 3, this extends the circuitous flow path of fluid through the rotor 42 area. Each rotor vane 52 bends into an end barrier 56 at its outlet end. As shown in FIG. 2, a plurality of orifices 58 are drilled each rotor vane 52.

The shape of the fin 54 in combination with axial and radial angles of the rotor vanes 52 is such that when the actuator 12 rotates the drive shaft 28, fluid is forced to flow in an axial direction from the inlet opening 18 to the outlet opening 20. The effect of the fins 54 and the angles of the rotor vanes 52 creates a fluid vortex that propels the fluid forward in an annular path of motion.

Figure 7B:
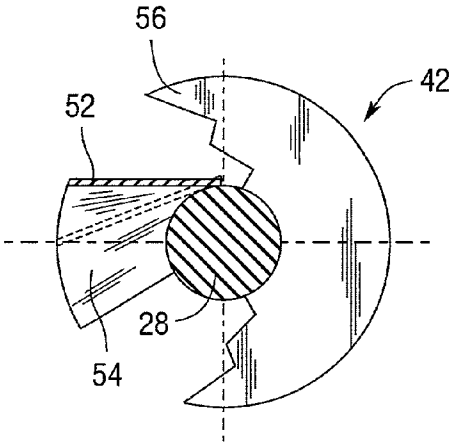
FIG. 7B is a cross sectional rear view of FIG. 7A.
Figure 7A:
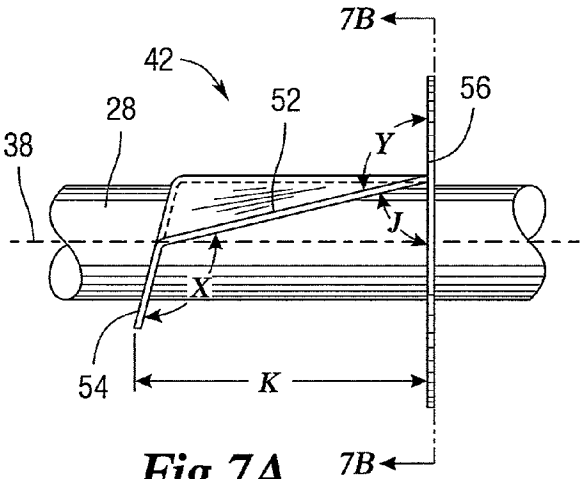
FIG. 7A is a side view of a single rotor vane having a compound angle.

The angles of the rotor vanes 52 are best understood by comparing FIGS. 7A and 7B. The compound angles of the rotor vanes 52 are best understood with reference to the construction of the rotor 42, the individual rotor vanes 52, fins 54, and the end barriers 56. Each rotor vane 52 is formed from a single strip of sheet metal that is bent to form a fin 52 and its own portion of the end barrier 56. At the inlet end of the rotor 52, the single strip of sheet metal is bent at an angle X with respect to the rotor vane 52 to form a fin 54. In the illustrated embodiment the angle X is 104.5 degrees. At the opposite end of the strip, the sheet metal is bent in the opposite direction at an angle Y to form a portion of the end barrier 56 of the rotor 42. As best seen in FIG. 4, the fin 54 is cut to a length that enables it to extend past the plane of an adjacent rotor vane 52 and is shaped to fit tightly around the drive shaft 28. All of the fins 54 together extend the circuitous flow path of the fluid from the inlet end of their respective rotor 42 and through their respective turbine chamber 34. The end barrier portion 56 is also cut to engage an adjacent rotor vane 52 and fit tightly around the drive shaft 28.

As is evident in FIG. 7A, the axial length of the rotor vane 52 is installed at a tilted angle Y to the axis of rotation 38. The end barrier 56 is perpendicular to the axis of rotation 38. In the embodiment illustrated in FIG. 7A, the rotor vane 52 is installed at an angle Y 193.5 degrees with respect to the axis of rotation 38. Referring to FIG. 7B, the radial length of the rotor vane 52 is tilted with respect to the drive shaft 28. In the end, the rotor vanes 52 on at least one of the rotors 42 are mounted at compound angles such that the axial length of each of the rotor vanes 52 is at an acute angle with respect to the axis of rotation 38 and the radial length of each of the rotor vanes 52 is tilted at a second angle with respect to the surface of the drive shaft 28.

Once the plurality of rotor vanes 52 are formed with their fins 54 and end barriers 56, an equal number of straight, parallel, shallow grooves (sometimes called script marks), are carved on the drive shaft 28 at the angle J (which represents the supplementary angle to angle Y) for the purpose of guiding where the rotor vanes 52 are to be mounted onto the drive shaft 28. The preformed rotor vanes 52 are then inserted to fit tightly within the script marks on the drive shaft 28 and joined so that the rotor vanes 52, fins 54 and end barriers 56 are permanently in their respective places. Once joined to the drive shaft 28, all end barriers 56 are all welded together, the welds are smoothed over so the end of the rotor 42 is sealed to prevent fluid from passing through.

The rotor vanes 52 are mounted so that each rotor vane 52 maintains a equal distance to the adjacent rotor vanes 52 along their entire length from the fin 54 to the end barrier 56. In the illustrated embodiment, there is an equal distance of 0.875 inches between each adjacent rotor vane 52 and each fin 54 partially overlaps the closest adjacent fin 54 in such a way as to form an inlet path as shown by the fluid flow arrows shown in FIG. 3 and discussed below. The partially overlapping fins 54 prevent fluid backflow within the system.

Comparing FIGS. 7A and 7B, in the illustrated embodiment the strips of sheet metal from which the rotor vane 52, fin 54 and end barrier 56 were formed were about 3.25 inches long and about one inch wide. The fin 54 is 1 inch long, and the rotor vane 52 is 1.5 inches long. The end barrier 56 is formed so that it is 0.75 inches high and there is a distance of 0.875 inches between the distal ends of the bodies of each adjacent rotor vane 52, as stated above. The axial length of the combined rotor vane 52 and fin 54, K, is approximately 1.8 inches. The dimensions of the rotor vane 52, the fin 54, and the end barrier 56, the angles X between the rotor vane 52 and the fin 54, and the angle Y between the axial length of rotor vane 52 and the end barrier 56, and the substantially tangential angle formed by the radial length of the rotor vane 52 with the surface of the shaft 28 were all determined empirically. Those skilled in the art will recognize sizes of the components of the rotor 42 and the angles at which they are formed and mounted can be changed without departing from the scope of what has been taught through the illustrated embodiment.

Figure 8C:
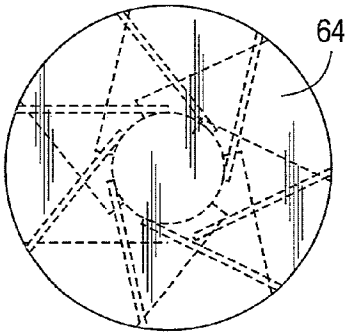
FIG. 8C is a rear view of FIG. 8A.
Figure 8A:
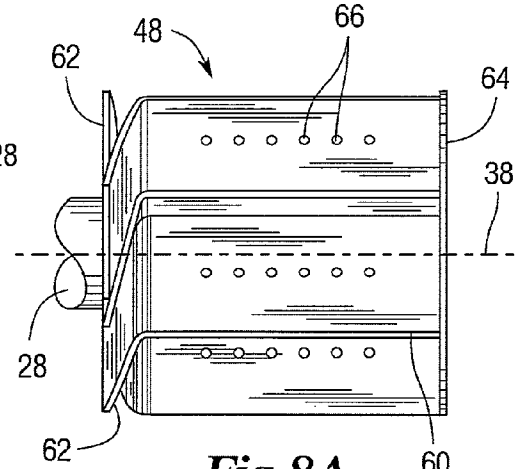
FIG. 8A is a side view of a rotor having rotor vanes not at compound angles.
Figure 8B:
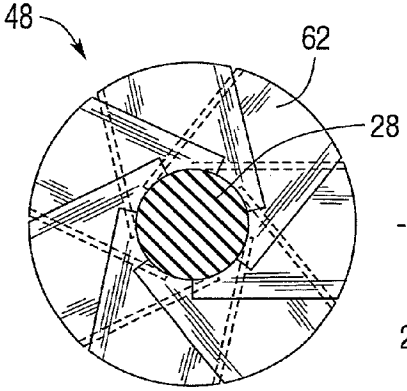
FIG. 8B is a front view of FIG. 8A.

The rotors 48 for the outlet chamber 36 can be seen by referring to FIGS. 8A, 8B, and 8C. Unlike the turbine chamber 34, the rotor vanes 60 on the rotor 48 of the outlet chamber 36 are parallel with the axis of rotation 38. The rotor vanes 60 comprise a plurality of fins 62. As seen in FIGS. 8B and 8C, which show the front and rear views of a rotor 48, each rotor vane 60 ends at an end barrier 64.

Figure 9B:
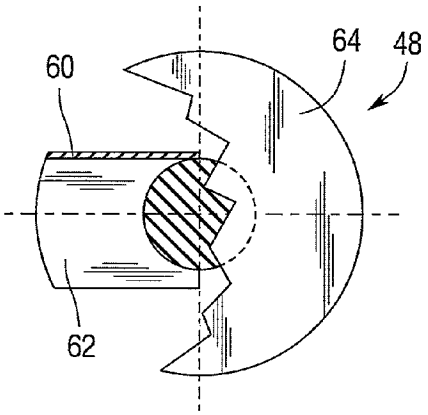
FIG. 9B is a cross sectional rear view of FIG. 9A.
Figure 9A:
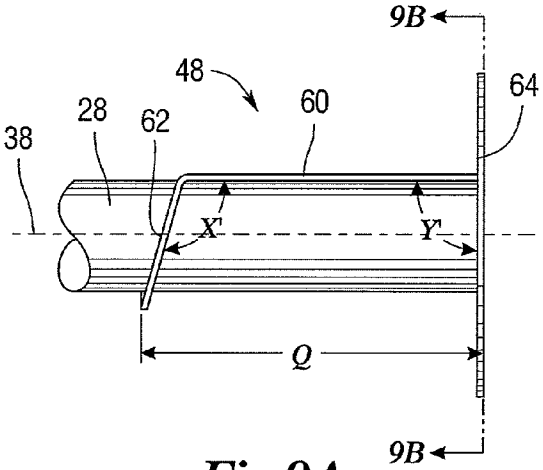
FIG. 9A is a side view of a single rotor vane not at a compound angle.

The rotor 48 is best understood by following the steps of their construction of the rotor vanes 60, their fins 62, and the end barrier 64. As shown in FIG. 9A, each rotor vane 60, fin 62 and end barrier 64 is formed from a single strip of sheet metal. At one end of each strip the sheet metal is bent at an angle X' with respect to the rotor vane 60 to form the fin 62. In the illustrated embodiment the angle X' is 104.5 degrees below the axis of rotation 38. At the opposite end of the strip, the sheet metal is bent in the same direction at an angle Y' to form the end barrier 64 of the rotor 48. As seen in FIG. 4, the fin 62 is cut to a length that enables it to overlap adjacent fins 62. As will be discussed below, the adjacent fins 62 form an inlet path between them to allow fluid to flow circuitously from the inlet opening 18 and through the outlet chamber 36. The end barrier 64 is also cut to engage an adjacent end barrier 64 and fit tightly around the drive shaft 28. A plurality of orifices 66 are drilled into the portion of the sheet metal that forms the rotor vane 60.

As shown in FIG. 9A, the axial length of the rotor vane 60 is installed parallel to the axis of rotation 38. The end barrier 64 is perpendicular to the axis of rotation 38 (at an angle Y' that is 90 degrees with respect to the axis of rotation 38). Referring to FIG. 9B, the radial length of the vane 60 is tilted with respect to the drive shaft 28.

Once the plurality of rotor vanes 60, fins 62, and end barriers 64 have been formed, an equal plurality of script marks, are carved on the drive shaft 28 parallel to the axis of rotation 38, for the purpose of guiding the rotor vanes 60 into their respective locations during construction. The pre-formed rotor vanes 60 are then inserted to fit tightly within the script marks on the drive shaft 28 and joined so that the rotor vanes 60, fins 62, and end barriers 64 are permanently in their respective places. Once joined to the drive shaft 28, all end barriers 64 are all welded together, the welds are smoothed over so the end of the rotor 48 for the outlet chamber 36 is sealed to prevent heated fluid from passing through.

The rotor vanes 60 are mounted in a way so that each rotor vane 60 remains in a straight line from its fin 62 to the vane's distal end where the rotor vane 60 has been welded to form the end barrier 64. In the illustrated embodiment, there is an equal distance of 0.875 inches between the distal ends of the bodies of each adjacent rotor vane 60, and each fin 62 extends past the plane of the closest adjacent rotor vane 60 in such a way as to form an inlet path as shown by the fluid flow arrows shown in FIG. 3 and discussed below.

Comparing FIGS. 9A and 9B, in the illustrated embodiment the strips of sheet metal from which the rotor vane 60, fin 62 and end barrier 64 are formed are about 3.5 inches long and about one inch wide. The fin 62 is approximately 0.75 inches long, and the rotor vane 60 is approximately 2 inches long. The end barrier 64 is formed so that it is 0.875 inches high and there is a distance of 0.875 inches between the distal ends of the bodies of each adjacent vane, as stated above. The axial length of the combined rotor vane 60 and fin 62, Q, is approximately 2 inches. The dimensions of the rotor vane 60, the fin 62 and the end barriers 64, the angles X' between the rotor vane 60 and the fin 62, and the angle Y' between the axial length of rotor vane 60 and the end barrier 64, and the substantially tangential angle formed by the radial length of the rotor vane 60 with the surface of the drive shaft 28 were all determined empirically. Those skilled in the art will recognize sizes of the components of the rotor 48 and the angles at which they are mounted can be changed without departing from the scope of what has been taught through the illustrated embodiment.

As noted above, FIGS. 2 through 9 show that each of the rotor vanes 52 of each turbine chamber 34 has a plurality of rotor orifices 58 drilled into the portion of the sheet metal that forms the rotor vane 52 and that that each of the rotor vanes 60 of the outlet chamber 36 has a plurality of rotor orifices 66 drilled into the portion of the sheet metal that forms the rotor vane 60. These rotor orifices 58 and 66, allow fluid to pass through to further increase the thermal energy generated as the rotors 42 and 48 rotate. The rotor orifices 58 and 66 may be a series of holes, openings, slits or apertures and create additional thermal energy by causing friction between the fluid and the surfaces of the rotor orifices 58 and 66 of the rotor vanes 52 and 60. Adding more thermal energy to the fluid making the fluid heat up more than the fluid would without these orifices 58 and 66. The number of orifices 58 and 66 to be used and the size and shape of each orifice is determined empirically, depending on the type of fluid being used, its viscosity, and the thermal effects desired from fluid flow through the orifices 58 and 66.

As shown in FIGS. 6A, 6B, 8A and 8B, the fins 54 and 62, discussed above, are located at the inlet end of the turbine chambers 34 and the outlet chamber 36. As can be best seen in FIGS. 6A and 8A, each fin 54, 62 is bent inward towards the center line of the axis of rotation 38, as explained above. Each fin 54, 62 partially overlaps an adjacent fin 54, 62 on its respective rotor 42, 48 leaving enough space between the end of the overlapping fin 54, 62 and the adjacent fin 54, 62 so that fluid is able to pass through this space. This overlap is formed so that the plurality of fins 54, 62 creates an impeller when the rotors 42 and 48 rotate, which causes a propelling force that cycles the fluid forward between the rotor vanes 52, 60, respectively.

Referring now to FIGS. 10A through 11C, each of the turbine chambers 34 comprises a fixed stator 40 which remains completely stationary while the rotors 42 rotate with the drive shaft 28 around the axis of rotation 38. The stators 40 have stator divots 68 that help locate and position the stator 40 within the outer housing 16 by lining up with the guiding ridge 50. This locks the entire stator 40 in place causing the stator 40 to be stationary while within the system 10. Each of the stators 40 has a plurality of axially extending stator vanes 70. The stator vanes 70 on at least one of the stators 40 are mounted at compound angles such that the axial length of each of the stator vanes 70 is at an acute angle with respect to the axis of rotation 38 and the radial length of each of the stator vanes 70 is tilted at a second angle with respect to the surface of the drive shaft 28. The rotor 42 and stator 40 of each turbine chamber 34 is sized and mounted so as to form a shearing plane between them.

Figures 10A, 10B, 10C:
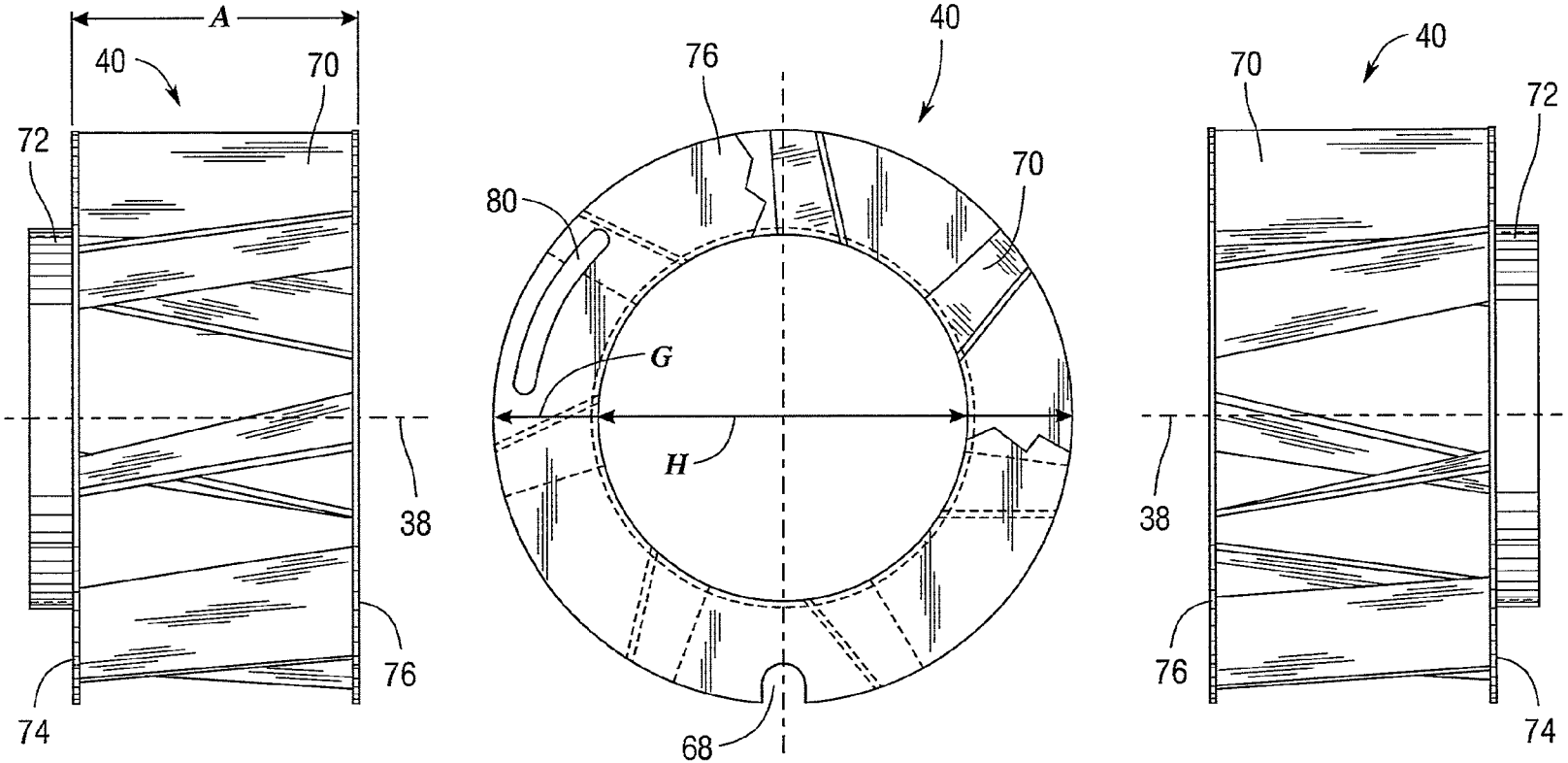
FIG. 10A is a cross-sectional rear view of a stator which is part of a turbine chamber that is not located closest to the inlet end or the outlet end of the system.
FIG. 10B is a left hand side view of FIG. 10A.
FIG. 10C is a right hand side view of FIG. 10A.
Figures 11A, 11B, 11C:
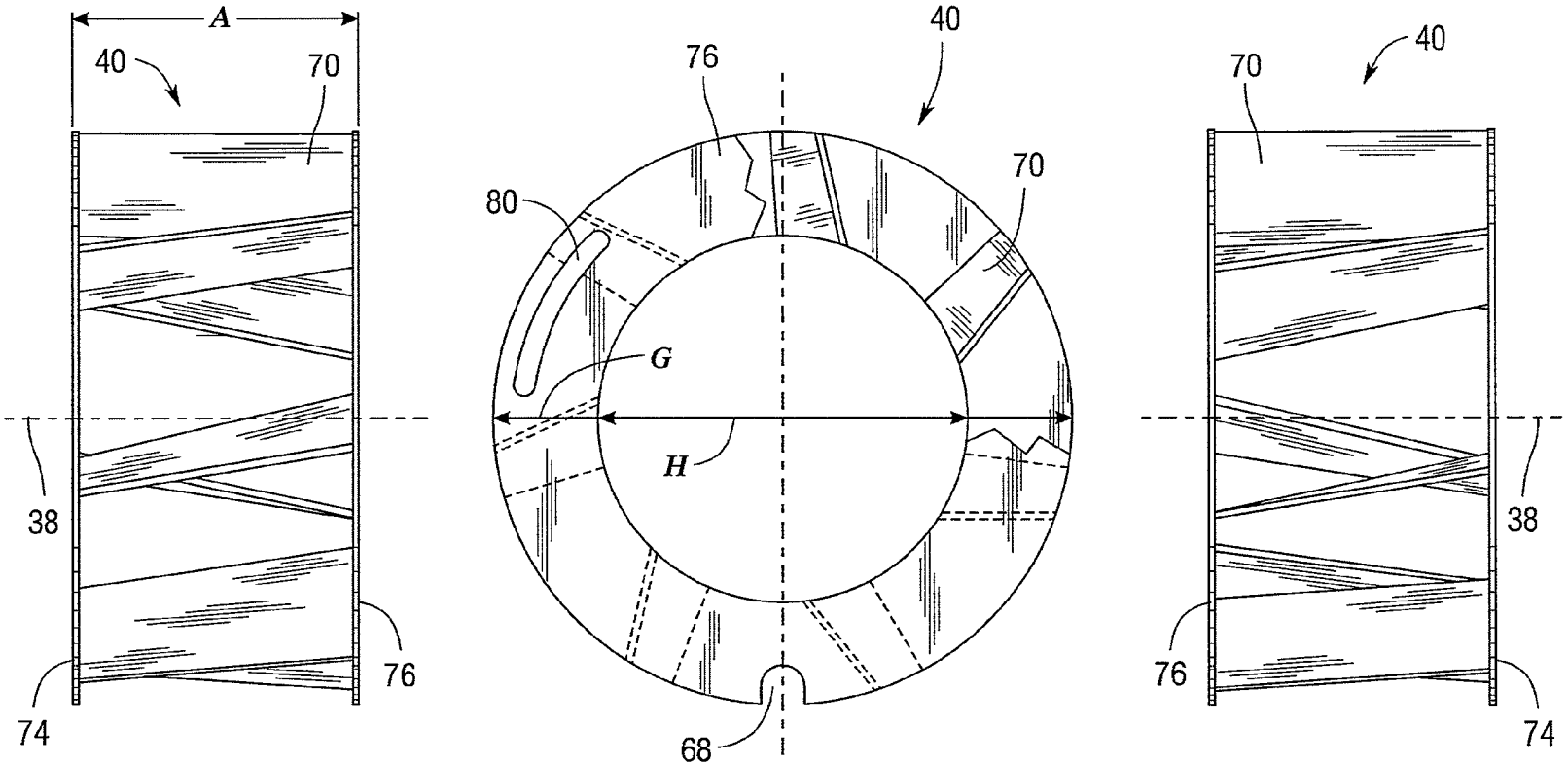
FIG. 11A is a cross-sectional rear view of a stator which is part of a turbine chamber that is located closest to the inlet.
FIG. 11B is a left hand side view of FIG. 11A.
FIG. 11C is a right hand side view of FIG. 11A.

The stators 40 shown in FIGS. 10A through 10C are identical to the stators 40 shown in FIGS. 11A through 11C except for the chamber entrance lip 72. As shown in FIG. 3, each of the entrance lips 72 directs the fluid flow to the rotor vanes 52. In the embodiment shown in the figures, the stator 40 of the first turbine chamber 34 does not require a lip of its own as the fluid flows directly into the rotor 42 from the inlet opening 18. With this one exception, the stators 40 shown in FIGS. 10A through 11C are identical.

The stators 40 are best understood in connection with their construction. The stators 40 are created by releasably clamping strips of sheet metal that are each 1.5 inches in length and 0.625 inches wide to the distal end of the rotor vanes 52. A donut shaped stator first end member 74 is then permanently joined to an end of the strip of sheet metal. A donut shaped second end member 76 is then permanently joined to the opposite end of the strip of sheet metal. Thus, each strip of sheet metal becomes an axially extending stator vane 70 when the construction of the stator 40 is complete. Moreover, the stator vanes 70 are joined to both the first end member 74 and the second end member 76 so that the stator vanes 70 are sandwiched between them. The stator vanes 70 line up with the rotor vanes 52 in each chamber but are staggered with respect to the stator vanes 70 in adjacent turbine chambers 34 to produce less shearing resistance.

The first end member 74 and the second end member 76 are the end walls of the turbine chamber 34 and the second end member 76 supports a separating plate 78, explained below. The second end member 76 has at least one outlet orifice 80 that is situated at the outlet end to allow fluid to flow through at least one opening in an adjacent separating plate orifice 80 and into an adjacent turbine chamber 34 as discussed further below. The outlet orifice 80 is shown as a single opening but it could be multiple openings or any other configuration that will provide sufficient retention time of the fluid in a particular turbine chamber 34 against the need to maintain a fluid flow rate through the system.

Each stator 40 has an outer diameter G measured by the length of the diameter of the stator's 40 full cross-section. In the illustrated embodiment, each of the stators 40 has an outer diameter G that is approximately 3.5 inches. The inner diameter H of the stator 40 is measured by the diametrical length of the stator's 40 cross-section from one side of the stator's 40 inner circumference to the polar opposite side. In the illustrated embodiment inner diameter H is approximately 2 inches. Furthermore, each stator 40 has an outer diameter G and an inner diameter H of exactly the same length.

Figure 12B:
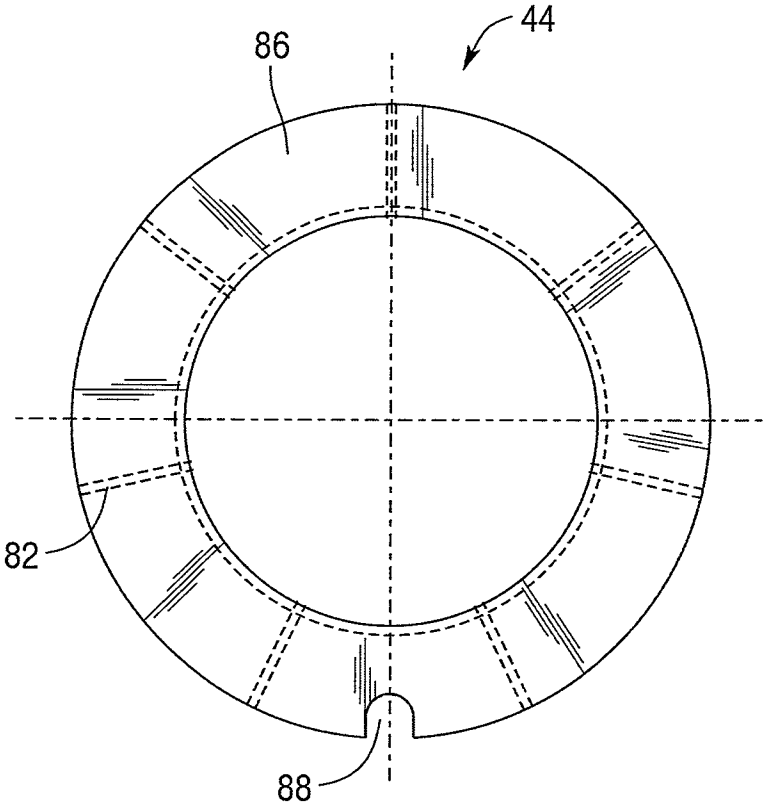
FIG. 12B is a cross sectional rear view of FIG. 12A.
Figure 12A:
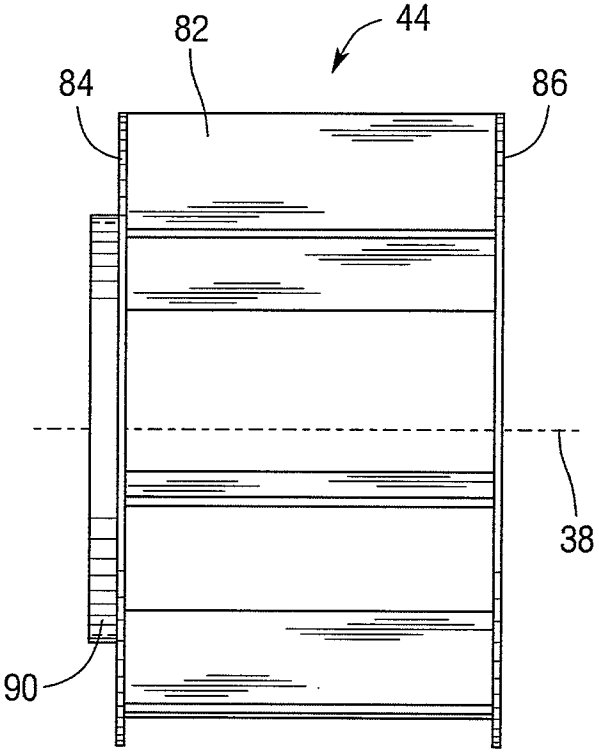
FIG. 12A is a side view of an embodiment of a stator which is designed to be a part of a turbine chamber that sits closest to the outlet.

FIGS. 12A and 12B, show the stator 44 of the outlet chamber 36. Each stator 44 comprises a series of stator vanes 82 that are parallel with the drive shaft 28. As with the outlet chamber's 36 rotor vanes 60, the stator vanes 82 now force the fluid primarily in the radial direction outward and away from the axis of rotation 38 as compared to the turbine chamber 32 which creates a vortex path that propels the fluid primarily in the axial direction.

The stators 44 are best understood in connection with their construction. The stator 44 is constructed by releasably clamping strips of sheet metal to the distal end of the rotor vanes 60. A donut shaped first end member 84 is permanently joined to an end of the strip of sheet metal. A donut shaped second end member 86 is then permanently joined to the opposite end of the strip of sheet metal. In turn, each strip of sheet metal becomes an axially extending stator vane 82 on the completed stator 44. The vanes are joined to both the first end member 84 and the second end member 86 so that the stator vanes 82 are sandwiched between them. The stator vanes 82 line up with the rotor vanes 60 in turbine chamber 36 but are staggered with respect to the stator vanes 70 in adjacent turbine chambers 34. The strips of sheet metal that become the stator vanes 82 are each approximately 2 inches in length and a half an inch in width.

The first end member 84 rests on the side of the stator 44 that is closer to the inlet opening 18 while within the system (as shown in FIG. 2). The first end member 84 and the second end member 86 make up a section of the outlet chamber 36. Both the first end member 84 and the second end member 86 have stator divots 88 that help locate and position the stator 44 within the outer housing 16 by lining up with the guiding ridge 50. This locks the entire stator 44 in place causing the stator 44 to be stationary while within the system 10. The first end member 84 has a chamber entrance lip 90 joined at its end around its inner circumference. As shown in FIG. 3, the entrance lip 90 directs the fluid flow to the rotor vanes 60.

Referring to FIG. 4, circular shaped separating plates 78 are located between adjacent turbine chambers 34 and between a turbine chamber 34 and the outlet chamber 36. The separating plates 78 separate the turbine chambers 34 and press up against the second end members 76. The separating plate 78 is shaped so that it does not come into contact with any part of the end barriers 56 or fins 54 of the rotors 42. The separating plate 78 also has at least one separating plate orifice 80 through which fluid can flow between the turbine chambers 34 and between a turbine chamber 34 and the outlet chamber 36.

Figure 13B:
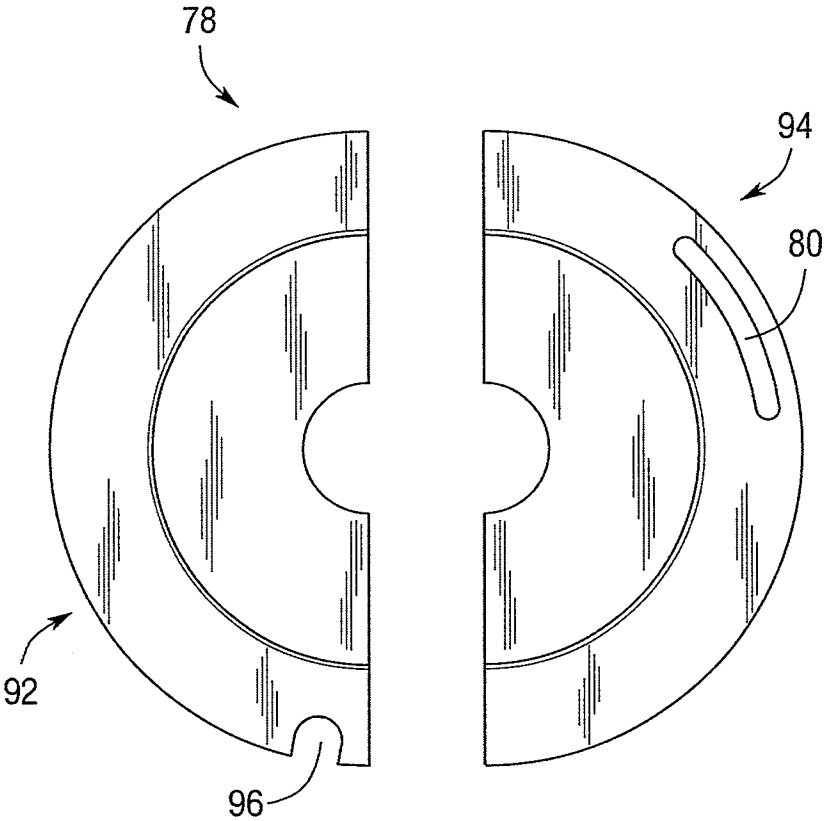
FIG. 13B is the front view of a separating plate as seen in FIG. 4.
Figure 13A:
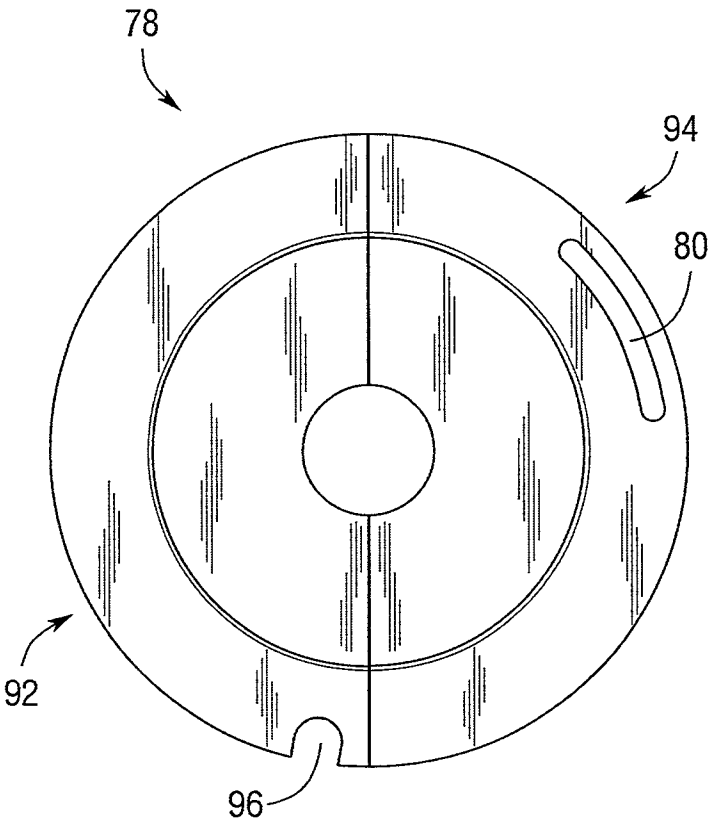
FIG. 13A is the front view of a separating plate with both halves fit together.

Referring to FIGS. 13A and 13B, the separating plate 78 is split vertically down the center creating two halves: the left half 92 and the right half 94. When the two halves are fit together they form a complete separating plate 78. In the construction of the system 10, each half 92 and 94 is inserted between the turbine chambers 34 and around the drive shaft 28 such that the separating plate 78 is stationary. The separating plate 78 has a separating plate divot 96 cut from the left half 92 so that when the separating plate 78 is fit together it slides over the guiding ridge 50 (shown in FIG. 4) and locks in a stationary position. The guiding ridge 50 also serves to line up the outlet orifice 80 of the second end member 76 of the turbine chamber 34 that it presses against with the separating plate orifice 80 located on the right half 94. This creates a channel through which fluid can flow between individual turbine chambers 34 or between a turbine chamber 34 and the outlet chamber 36.

Figure 14B:
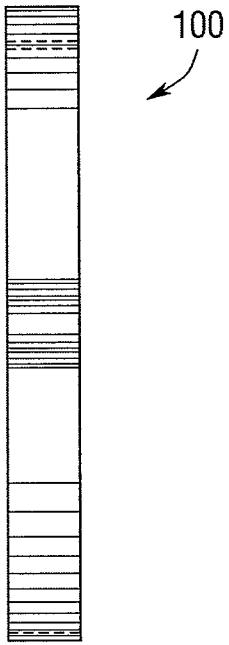
FIG. 14B is the side view of FIG. 14B.
Figure 14A:
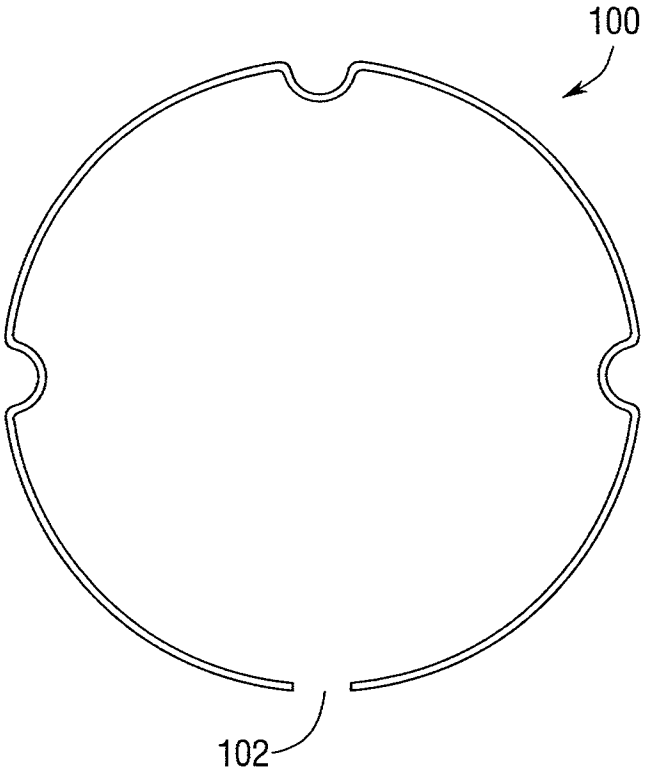
FIG. 14A is the front view of a chamber spacing spacer as seen in FIG. 4.

Referring to FIGS. 2 and 4, a chamber spacer 100 is used to establish a space between turbine chamber 34 and between the last turbine chamber 34 and the outlet chamber 36. The chamber spacer 100 also holds each separating plate 78 in place up against its respective turbine chamber 36 within the system 10. As seen in FIGS. 14A and 14B, each chamber spacer 100 also has a gap 102 that aligns with both the separating plate divots 96 and the stator divots 68 and 88 so that the chamber spacer 100 is stationary in a same manner as each of the stators 40 and 44 and separating plates 78.

Referring generally to FIGS. 2 and 3, rotors 42, 48 and stators 40, 44 of each respective turbine chamber 34 and the outlet chamber 36 are sized and mounted so as to form a shearing plane between the rotor vanes 52, 60 and stator vanes 70, 82. As the rotors 42 and 48 rotate, this movement causes the rotor vanes 52 and 60 to rapidly rotate past the corresponding stator vanes 70 and 82, which provides a shearing action on the fluid, as the fluid passes between each of the vanes. This shearing action causes the fluid to rapidly heat while within each chamber. The shearing action is identical in all turbine chambers 34 and the outlet chamber 36. Each of the turbine chambers 34 and the outlet chamber 36 independently heats the fluid so as to cause a heating effect as the fluid passes from the inlet opening 18 to the outlet opening 20. Thus, as the fluid passes through the system 10, the fluid incrementally becomes hotter from one chamber to the next until the fluid reaches its hottest temperature just as the fluid leaves through the outlet opening 20. As the system 10 is connected to a closed fluid loop, continuous cycles of heated fluid will provide a constant supply of heated fluid for heating the structure in which the system is located.

The shearing planes are not the only source of fluid heating within the system 10. The fins 54 and 62 and the resulting inlet path, the compound angles of the rotor vanes 52, the rotor orifices 58 and 66, the shearing plane, the outlet orifices 80, and the separating plate orifices 98 create thermal energy as the fluid is transferred along and between the rotor vanes 52 and 60 as well as the stator vanes 70 and 82, through the shearing planes and between the adjacent turbine chambers 34 and the outlet chamber 36 as the fluid flows circuitously from the inlet opening 18 to the outlet opening 20. The temperature and flow can be further regulated by varying the RPM with the drive shaft 28.

As shown in FIG. 3, the fluid flows between the turbine chambers 34 and the outlet chamber 36 in a circuitous manner. As fluid enters the system 10, the fluid enters through the inlet opening 18 and passes directly into the first turbine chamber 34 through the gap between adjacent fins 54 of the rotor 42. As the rotor 42 rotates, the fins 54 act as an impeller that both forces fluid forward as well as causes friction between the fluid and the fins 54 that is a factor in heating the fluid. After passing beyond the fins 54, the fluid is further propelled forward by the vortex effect created by fluid flowing between the compound angles of the rotating rotor vanes 52. As the fluid passes along one set of the rotor vanes 52, the fluid is pushed through the rotor orifices 58 and between adjacent sets of rotor vanes 52. Pushing the fluid between the rotor vanes 52 in this manner causes additional friction between the fluid and the rotor orifices 58. The fluid is also forced upward beyond the shearing plane and between the stator vanes 70 as the fluid flows throughout and between the rotor vanes 52. After being pushed along and between the rotor vanes 52 as well as between the corresponding stator vanes 70, the fluid then passes through the channel created by the outlet orifices 80 in the second end member 76 and the corresponding separating plate orifice 98 into the next turbine chamber 34 (indicated in FIG. 3, but best show by comparing FIGS. 3 and 4). The fluid passing through these orifices creates another factor in heating the fluid. When the fluid exits one turbine chamber 34 and enters the next turbine chamber 34 or the outlet chamber 36, the fluid goes past the chamber entrance lip 72 and 90 into the next chamber.

Fluid repeats the path discussed above through each turbine chamber 34 and finally through the outlet chamber 36. However, because rotor vanes 48 and stator vanes 44 are parallel with the axis of rotation 38, when the fluid reaches the outlet chamber 36 instead of being propelled forward by a vortex the fluid is propelled axially outward by the rotor vanes 48 and toward the outlet housing 16 creating pressure such that the fluid must escape through the outlet opening 20 and exit the system 10. When the fluid exits the system 10 it will be warmer than when it entered the system 10. Repeated cycles of the fluid passage in a closed loop will see the system 10 significantly increase the temperature of fluid passing through it.

It is understood that the number of turbine chambers 34 could be varied from as few as one to as many as will fit in the system 10. The outlet housing 16 can also be expanded to house more than just three turbine chambers 34. It should also be noted that the outlet chamber 36 as discussed above need only have rotor vanes and stator vanes that direct the fluid flow in a radial direction for embodiments in which the outlet opening 20 is perpendicular to the axis of rotation 38 of the drive shaft 28. It is understood that there could be embodiments in which the outlet opening 20, is parallel to the axis of rotation 38 of the drive shaft 28. In these embodiments, the outlet chamber 36 would be configured to have rotors and stators similar to those of the turbine chambers 34 in that the rotor vanes and stator vanes would be angled to create a propelling force that cycles the fluid forward in an axial direction. In essence, there would be no discernable difference between the turbine chambers 34 and the outlet chamber 36 in these embodiments. Moreover, there could also be embodiments in which the surface of the turbine chambers 34 and 36 could be etched or coated with a material that will add texture to the surface to cause additional friction as fluid passes over the textured surface and increase the thermal energy generated.

Figure 15:
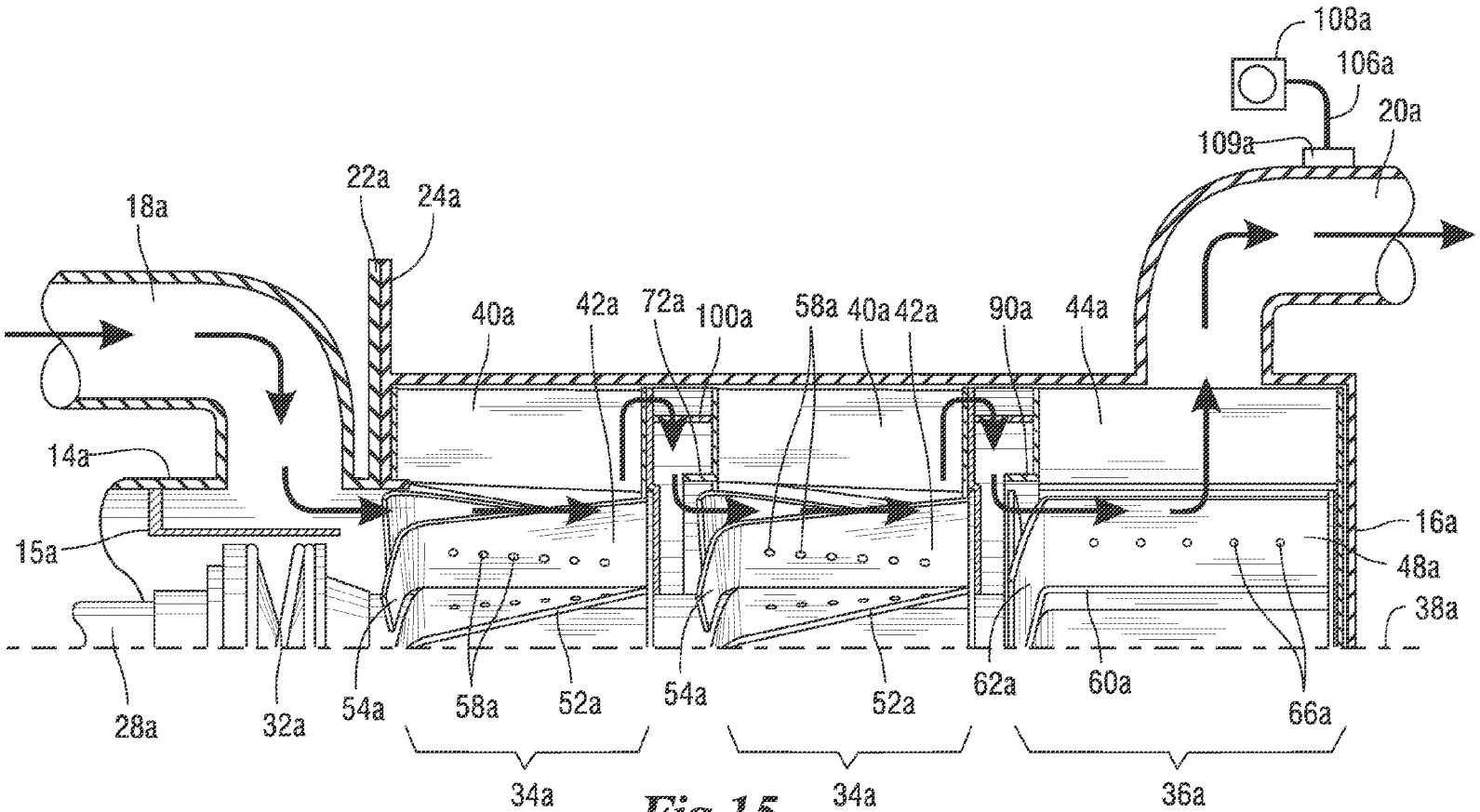
FIG. 15 is a cut away side view of an embodiment having inlet and outlet openings that extend parallel to the axis of rotation.

As shown in FIG. 15, the inlet opening 18*a* and the outlet opening 20*a* may be parallel to the axis of rotation 38*a*. This configuration gives the user different options for configuring the fluid heating and pumping system for installation. In addition, this embodiment shows one variation of feedback control for the system. Here a thermostat 109*a* is mounted to the outlet opening 20*a* to measure the temperature of the fluid leaving the system. This thermostat 109*a* is connected to a motor control unit 108*a* by means of a wire 106*a*. It will be understood that this included solely for purposes of illustration as those of skill in the art will recognize that any feedback control system is could be similarly attached. The feedback control located at the outlet opening 20*a* provides an indication of how well the system is performing and would shut down the system when set temperature range is reached. However, if the feedback control were to be located at the inlet opening 18*a*, this would indicate that the temperature of the fluid entering the system which, if the temperature is at a set target would signal the system to cease operation. It would also be possible to include feedback systems at both the inlet and the outlet openings to get a better sense of how well the system is performing.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A fluid heating and pumping system comprising:

a housing having an inlet opening and an outlet opening;

a plurality of turbine chambers within said housing; each of said turbine chambers having an inlet end and an outlet end; each of said turbine chambers comprising a stator and a rotor both of which are centered on an axis of rotation; each of said rotors is mounted to a driveshaft; said driveshaft rotates about said axis of rotation; each of said turbine chambers constructed to create a circuitous flow path for fluid flow;

a separating plate located between adjacent said turbine chambers, said separating plate having at least one separating plate orifice through which fluid can flow between adjacent said turbine chambers;

each of said rotors designed to move the fluid axially or radially through said housing; each of said rotors having a plurality of rotor vanes with each of said rotor vanes having a fin at said inlet end; said fin extending past the plane of an adjacent said rotor vane to extend said circuitous flow path through said rotors;

each of said stators having a plurality of axially extending stator vanes, said rotor and said stator sized and mounted to form a shearing plane between them; each of said stators having an end member with at least one outlet orifice situated at said outlet end to allow fluid to flow through at least one opening in an adjacent said separating plate orifice; and said fins, said shearing plane, and said outlet orifice creating thermal energy as the fluid is transferred along and between said rotor vanes and said stator vanes, through said shearing plane and between the adjacent said turbine chambers as the fluid flows circuitously from said inlet opening to said outlet opening.

2. The fluid heating and pumping system of claim 1 further comprising each of said rotor vanes having a plurality of rotor orifices through which fluid can pass to further increase the thermal energy generated as said rotor rotates.

3. The fluid heating and pumping system of claim 1 having three said turbine chambers within said housing.

4. The fluid heating and pumping system of claim 1 further comprising said outlet opening is perpendicular to said axis of rotation and said turbine chamber that is positioned closest to said outlet opening within said housing is an outlet chamber designed to move the fluid radially within said housing such that said fluid flows through said outlet opening.

5. The fluid heating and pumping system of claim 1 further comprising said outlet opening is perpendicular to said axis of rotation and said turbine chamber positioned closest to said outlet opening within said housing is an outlet chamber having said rotor vanes mounted both radially and parallel to said axis of rotation such that said fluid flows through said outlet opening.

6. The fluid heating and pumping system of claim 1 further comprising at least one of said turbine chambers having each of said rotor vanes and each of said stator vanes mounted at compound angles such that the axial length of each of said rotor vanes and stator vanes are at an acute angle with respect to said axis of rotation and the radial length of each of said rotor vanes and stator vanes are tilted at a second angle with respect to the surface of said drive shaft.

7. The fluid heating and pumping system of claim 1 further comprising said inlet opening and said outlet opening are mounted such that both extend perpendicular to said axis of rotation.

8. The fluid heating and pumping system of claim 1 further comprising said inlet opening and said outlet opening are mounted such that both extend parallel to said axis of rotation.

9. The fluid heating and pumping system of claim 1 further comprising said outlet opening is mounted such that said outlet opening is parallel to said axis of rotation.

10. The fluid heating and pumping system of claim 1 further comprising said inlet opening is mounted such that said inlet opening is parallel to said axis of rotation.

11. The fluid heating and pumping system of claim 1 further comprising a thermostat, thermocouple, or other temperature sensitive feedback device.

12. The fluid heating and pumping system of claim 1 further comprising each of said turbine chambers having textured surfaces.

* * * * *